US007749018B1

(12) United States Patent
Benoit et al.

(10) Patent No.: US 7,749,018 B1
(45) **Date of Patent: *Jul. 6, 2010**

(54) ELECTRICAL WIRING SYSTEM

(75) Inventors: John Benoit, Montpelier, VT (US); Gerald R. Savicki, Jr., Canastota, NY (US)

(73) Assignee: Pass & Seymour, Inc., Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/185,330

(22) Filed: Aug. 4, 2008

Related U.S. Application Data

(63) Continuation of application No. 11/274,817, filed on Nov. 15, 2005, now Pat. No. 7,407,410, and a continuation of application No. 10/680,797, filed on Oct. 7, 2003, now Pat. No. 6,994,585.

(51) Int. Cl.
*H01R 13/60* (2006.01)

(52) U.S. Cl. ..... 439/535; 439/536; 174/58

(58) Field of Classification Search ..... 439/535, 439/536, 650, 354; 174/53, 58, 480, 66, 174/67, 50; 220/241
See application file for complete search history.

(56) References Cited

U.S. PATENT DOCUMENTS

| | | | |
|---|---|---|---|
| 2,895,119 | A | 7/1959 | Montgomery, Jr. |
| 3,156,761 | A | 11/1964 | Schinske |
| 3,192,499 | A | 6/1965 | West |
| 3,369,211 | A | 2/1968 | Sundquist |
| 3,641,472 | A | 2/1972 | Phillips, Jr. |
| 3,975,074 | A | 8/1976 | Fuller |
| 4,008,940 | A | 2/1977 | Folley |
| 4,203,638 | A | 5/1980 | Tansi |
| 4,217,619 | A | 8/1980 | Tibolla |
| 4,273,957 | A | 6/1981 | Kolling, Jr. |
| 4,477,141 | A | 10/1984 | Hardesty |
| 4,725,249 | A | 2/1988 | Blackwood et al. |
| 4,842,551 | A | 6/1989 | Heimann |
| 4,865,556 | A | 9/1989 | Campbell et al. |
| 5,006,075 | A | 4/1991 | Bowden, Jr. |
| 5,015,203 | A | 5/1991 | Furrow |
| 5,117,122 | A | 5/1992 | Hogarth et al. |
| 5,146,385 | A | 9/1992 | Misencik |
| 5,178,555 | A | 1/1993 | Kilpatrick |
| 5,266,039 | A | 11/1993 | Boyer et al. |

(Continued)

OTHER PUBLICATIONS

Richter et al., Practical Electrical Wiring, 1993, 16th Edition, McGraw-Hill, U.S.; pp. 137-139, 176-177, 507-510.

(Continued)

*Primary Examiner*—Tho D Ta
(74) *Attorney, Agent, or Firm*—Daniel P. Malley; Bond, Schoeneck & King, PLLC

(57) ABSTRACT

The present invention is directed to an electrical wiring system. The system includes a plug connector device that is configured to terminate a plurality of wires. A portion of the plurality of wires are configured to transmit electrical power provided by an electrical power distribution system. An electrical wiring device is configured to provide the electrical power to a load. The electrical wiring device includes a receptacle disposed therein. The receptacle is configured to receive the plug device, such that electrical continuity is established between the electrical wiring device and the plurality of wires when the plug device is inserted into the receptacle.

37 Claims, 6 Drawing Sheets

U.S. PATENT DOCUMENTS

| | | | | |
|---|---|---|---|---|
| 5,281,154 | A | 1/1994 | Comerci et al. | |
| 5,297,973 | A | 3/1994 | Gorman | |
| 5,456,373 | A | 10/1995 | Ford | |
| 5,582,522 | A | 12/1996 | Johnson | |
| 5,654,857 | A | 8/1997 | Gershen | |
| 5,785,551 | A | 7/1998 | Libby | |
| 5,839,908 | A | 11/1998 | Bonilla et al. | |
| 5,964,618 | A | 10/1999 | McCarthy | |
| 6,028,268 | A | 2/2000 | Stark et al. | |
| 6,045,374 | A | 4/2000 | Candeloro | |
| 6,156,971 | A | 12/2000 | May | |
| 6,309,248 | B1 | 10/2001 | King | |
| 6,376,770 | B1 | 4/2002 | Hyde | |
| 6,377,427 | B1 | 4/2002 | Haun et al. | |
| 6,494,728 | B1 | 12/2002 | Gorman | |
| 6,563,049 | B2 | 5/2003 | May | |
| 6,657,144 | B2 | 12/2003 | Savicki, Jr. et al. | |
| 6,692,284 | B1 | 2/2004 | Koh | |
| 6,753,471 | B2 | 6/2004 | Johnson et al. | |
| 6,767,245 | B2 | 7/2004 | King | |
| 6,774,307 | B2 | 8/2004 | Kruse et al. | |
| 6,994,585 | B2 | 2/2006 | Benoit | |
| 7,189,110 | B1 | 3/2007 | Savicki | |
| 7,195,517 | B1 | 3/2007 | Savicki | |
| 7,285,009 | B1 * | 10/2007 | Benoit et al. | 439/535 |
| 7,407,410 | B1 | 8/2008 | Benoit | |
| 2002/0052139 | A1 | 5/2002 | Gorman | |
| 2002/0055301 | A1 | 5/2002 | Gorman | |
| 2005/0006124 | A1 | 1/2005 | Kruse et al. | |

OTHER PUBLICATIONS

Bryant Wiring Device Catalog BDB-1506; May 1994; pp. C12, D12, D16, F2, F5.

Leviton Wiring Device Catalog; D-200; 1978; Little Neck, NY; pp. C1, T9, T12.

Pass & Seymour Plug Tail Wiring Devices Brochure; Apr. 2004.

First Alert; User's Manual for Smoke and Fire Alarms; Jul. 2004; Mexico; pp. 1-6.

NEC 2005 Handbook; 2005; Article 314.17; Conductors Entering Boxes, Conduit Bodies, or Fittings; National Fire Protection Association, Inc.; p. 327.

UL Standard 514A; Metallic Outlet Boxes; Underwriters Laboratories Inc.; Tenth Edition; 2004; p. 39.

Earley et al., NEC 1999 National Electrical Code Handbook; NFPA 8th ed. (1999); pp. v-vii, 2, 69-70, 98.

BRK Electronics; User's Manual-Smoke Alarms; Jun. 2000.

P & S PlugTail Installation-Speed Comparison Video, Pass & Seymour web site (www.passandseymour.com/plugtail/video.cfm); Jun. 2007.

Engdahl, T; Telephone Ringing Circuits; 1997; www.tkk.fi/misc/electronics/circuits/telephone_ringer.html.

* cited by examiner 318
308'
310
316
318'
308

30
308
306
310
316
302

10
20
12
200
310
306
314
202
302
308

ELECTRICAL WIRING SYSTEM

CROSS-REFERENCE TO RELATED APPLICATIONS

This is a continuation application of U.S. patent application Ser. No. 11/274,817 filed on Nov. 15, 2005, which is a continuation application of U.S. patent application Ser. No. 10/680,797 filed on Oct. 7, 2003, the contents of which are relied upon and incorporated herein by reference in their entirety, and the benefit of priority under 35 U.S.C. §120 is hereby claimed.

BACKGROUND OF THE INVENTION

1. Field of the Invention

The present invention relates generally to electrical circuit installation, and particularly to electrical devices that facilitate installation of electrical circuits in a building or some other structure.

2. Technical Background

Installing electrical circuits in buildings and/or other structures is typically labor intensive, time-consuming, and a process that requires electricians of various skill levels. As a result the installation process is expensive. The first phase of the installation is commonly referred to as the "rough-in" phase. In new construction, either conduit or armored cable is disposed through out the structure in accordance with the building plans. Junction boxes are installed at appropriate locations, and brackets and metal device boxes are installed throughout the structure where electrical service is desired. Junction boxes, of course, are employed to house the connection point, or junction, of several conductors. Metal device boxes are used to accommodate electrical wiring devices. For example, the types of electrical wiring devices may include, but are not limited to, receptacles, switches, dimmers, GFCIs, transient voltage surge suppressors (TVSS), timer devices, sensors of various types, thermostats, lighting fixtures, and/or combinations thereof. After the boxes are placed, the electrical wires are pulled through the conduits and all of the circuits are bonded. At this point, the leads from the electrical wires extend from the boxes and are visible and accessible for the next phase of the installation process.

Before discussing the next phase of the process, it is noted that electrical cables may include two to five conductive wires. For example, in a structure that requires high power, the most common way of distributing that power is by employing the three-phase power system. As those of ordinary skill in the art recognize, five wires are employed. Three phase power includes three "hot" or "live" wires. Each of these wires transmits electrical power that is 120 degrees out of phase with the other two hot wires. The other two wires are the neutral conductor and the ground wire. Three phase power typically comes from the power utility via four wires: the three-phase wires, and the neutral. If the current flowing through each of the phases is equal, no current will flow through the neutral. The neutral wire is typically connected to the building ground at the structure's main distribution panel. The five wire cable is distributed from the central panel. Some of the circuits in the structure are designed to provide power to grounded equipment. These circuits may employ three wires, a line conductor (hot wire), a neutral conductor, and a ground. Some circuits may only employ two wires, the line conductor and the neutral conductor.

Referring back to the installation process, after the "rough-in" phase has been completed, the electrical wiring devices are terminated, i.e., they are electrically connected to the wire leads. This part of the installation process is the most costly and time consuming. A journeyman electrician must perform, or supervise, the connection of each wiring device in the structure. In this process, each electrical wire must be stripped and terminated to the device. What is needed is an efficient, labor-saving, and cost effective means for terminating the electrical wires and coupling them to the individual devices.

SUMMARY OF THE INVENTION

The present invention addresses the problems described above. The present invention is directed to an electrical wiring system that simplifies the installation process. Further, the present invention provides an efficient system and method for terminating electrical devices. The system and method is cost-effective because it eliminates many of the labor intensive practices that are currently in use.

One aspect of the present invention relates to an electrical wiring system that includes a plug connector device that is configured to terminate a plurality of wires. A portion of the plurality of wires are configured to transmit electrical power provided by an electrical power distribution system. An electrical wiring device is configured to provide the electrical power to a load. The electrical wiring device includes a receptacle disposed therein. The receptacle is configured to receive the plug device, such that electrical continuity is established between the electrical wiring device and the plurality of wires when the plug device is inserted into the receptacle.

In another aspect, the present invention includes a method for installing electrical wiring. The method includes installing a plurality of wires from a first location to an electrical device location. At least a portion of the plurality of wires are configured to transmit electrical power. The plurality of wires are then terminated using a plug connector. An electrical wiring device is configured to provide electrical power to a load. The electrical wiring device includes a receptacle disposed therein. The receptacle is configured to receive the plug device. The plug connector is inserted into the receptacle, such that electrical continuity is established between the electrical wiring device and the plurality of wires.

In yet another aspect, the present invention includes a plug connector configured to terminate a plurality of wires. The plurality of wires are configured to transmit electrical power provided by an electrical power distribution system. The connector includes a housing, and a plurality of self-locking contacts disposed in the housing. Each of the plurality of self-locking contacts are configured to terminate one of the plurality of wires, such that electrical continuity is established between the plurality of wires and the plurality of self-locking contacts.

In yet another aspect, the present invention includes a plug connector configured to terminate a plurality of wires. The plurality of wires are configured to transmit electrical power provided by an electrical power distribution system. The connector includes a housing, and a plurality of contacts disposed with the housing. A plurality of wire nut devices are coupled to corresponding ones of the plurality of contacts. Each of the at least one wire nut devices are configured to terminate one wire, such that electrical continuity is established between each wire and each contact.

In yet another aspect, the present invention includes a plug connector configured to terminate a plurality of wires. The plurality of wires are configured to transmit electrical power provided by an electrical power distribution system. The connector includes a first housing portion and a second housing portion configured to mate with the first housing portion. The first and second housing portions form the plug device housing. The plug connector also includes a plurality of contacts that include blade elements. The plurality of contacts may be disposed in either the first plug connector housing or the second plug connector housing or both. The blade elements are configured to displace insulation disposed on the plurality of wires when the second plug connector housing is coupled to the first plug connector housing, such that electrical continuity is established between each wire and a corresponding one of the plurality of contacts.

In yet another aspect, the present invention includes an electrical wiring device. The device includes a housing and at least one power output element disposed within the housing. The at least one power output element is configured to provide electrical power to a load. An input receptacle is also disposed within the housing. The input receptacle includes a plurality of electrical receptacle contacts. Electrical continuity is provided between the plurality of electrical receptacle contacts and the power output element such that electrical power may be transmitted from the plurality of electrical receptacle contacts to the power output element.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1B:
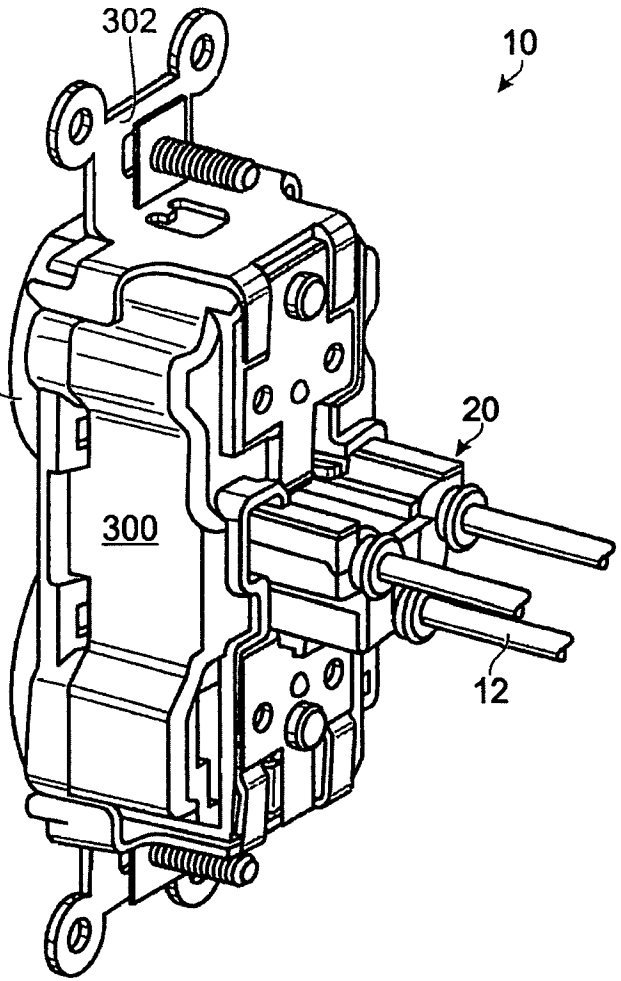
FIGS. 1A and 1B are perspective views of the electrical wiring system in accordance with the present invention.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the electrical wiring system of the present invention is shown in FIG. 1, and is designated generally throughout by reference numeral 10.

In accordance with the invention, the present invention is directed to an electrical wiring system. The system includes a plug connector device that is configured to terminate a plurality of wires. A portion of the plurality of wires are configured to transmit electrical power provided by an electrical power distribution system. An electrical wiring device is configured to provide the electrical power to a load. The electrical wiring device includes a receptacle disposed therein. The receptacle is configured to receive the plug device, such that electrical continuity is established between the electrical wiring device and the plurality of wires when the plug device is inserted into the receptacle. In light of the above, the present invention is directed to an electrical wiring system that simplifies the installation process by providing an efficient system and method for terminating electrical devices. Also, the system and method is cost-effective because it eliminates many of the labor intensive practices that are currently in use.

Figure 1A:
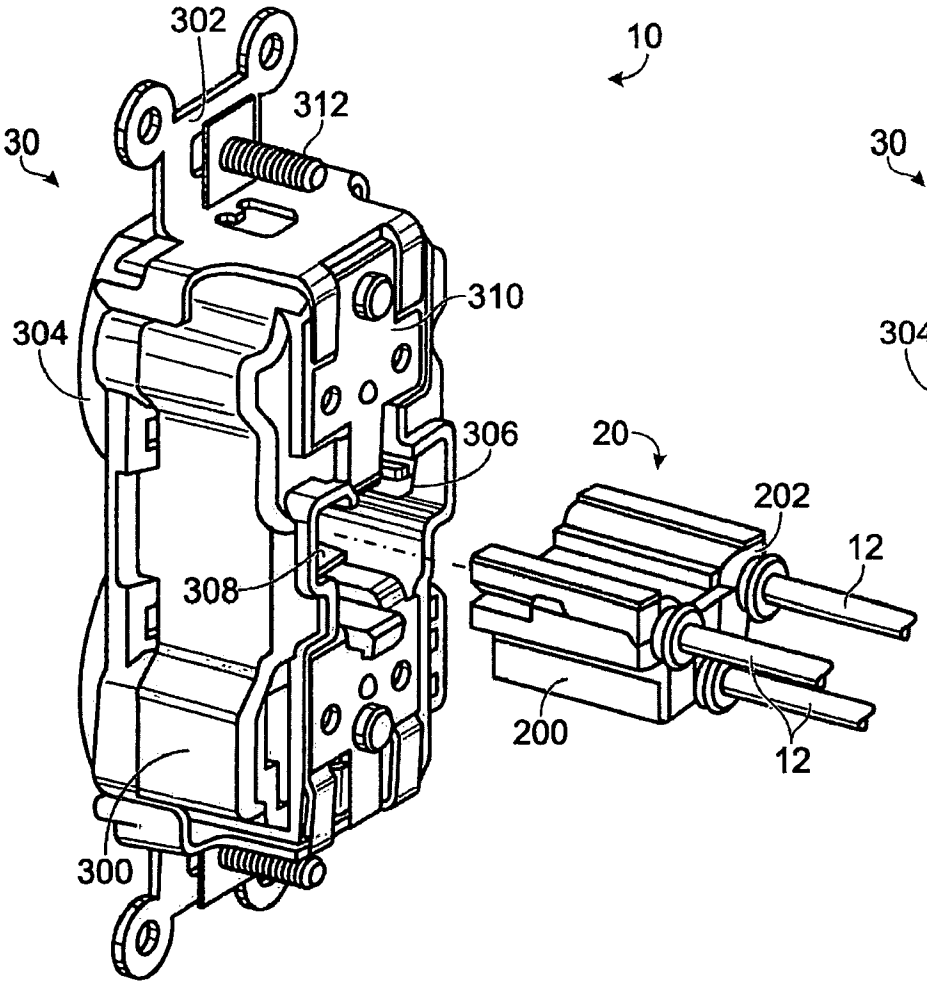

As embodied herein, and depicted in FIGS. 1A and 1B, perspective views of the electrical wiring system 10 in accordance with the present invention are disclosed. Referring to FIG. 1A, electrical wiring system 10 includes plug connector 20 which mates with electrical wiring device 30. Electrical power conductor wires 12 are terminated at plug 20. Plug 20 includes a housing 200 and contacts 202, which are disposed within body 200. In the embodiment shown, connector contacts 202 are female contacts designed to accept male contacts disposed within wiring device 30. In one embodiment, housing 200 is formed from injection molded plastic, polycarbonate, or other polymer based materials. Connector contacts 202 are typically fabricated using a copper alloy material. Those of ordinary skill in the art will recognize that any suitable material may employed in fabricating plug connector 20.

Electrical wiring device 30 includes a body 300, strap element 302, cover 304, power input receptacle 306, receptacle contacts 308, ground chassis 310, and mounting screws 312. In this embodiment, receptacle contact 308 is a male contact that is configured to mate with plug contact 202. Body 300 and cover 304 are injection molded components, again, using materials such as polymers, polycarbonate, or nylon materials. Contacts 308 are fabricated using copper alloy materials. Strap 302 may be fabricated using a copper alloy or by using plated steel. Ground chassis 310 is fabricated using a copper alloy. Because the embodiment shown is a 3-wie system that includes ground, ground chassis 310 includes a male contact tab that mates with one of the female contacts in plug 20.

In the example depicted in FIG. 1A and FIG. 1B, three wires are shown being terminated by plug 20. However, those of ordinary skill in the art will recognize that the present invention should not be construed as being limited to the embodiment shown. The present invention may be configured to accommodate 2 wire systems and three-phase (5 wires) systems, as well as the 3-wire system shown. Further, system 10 of the present invention may be adapted to a wiring system that employs more than 5 wires. While wires are shown being terminated by a single plug 20, those of ordinary skill in the art will recognize that the present invention may be configured to terminate the wires separately or in combination, within a plurality of plugs.

Figures 2, 3, 4:
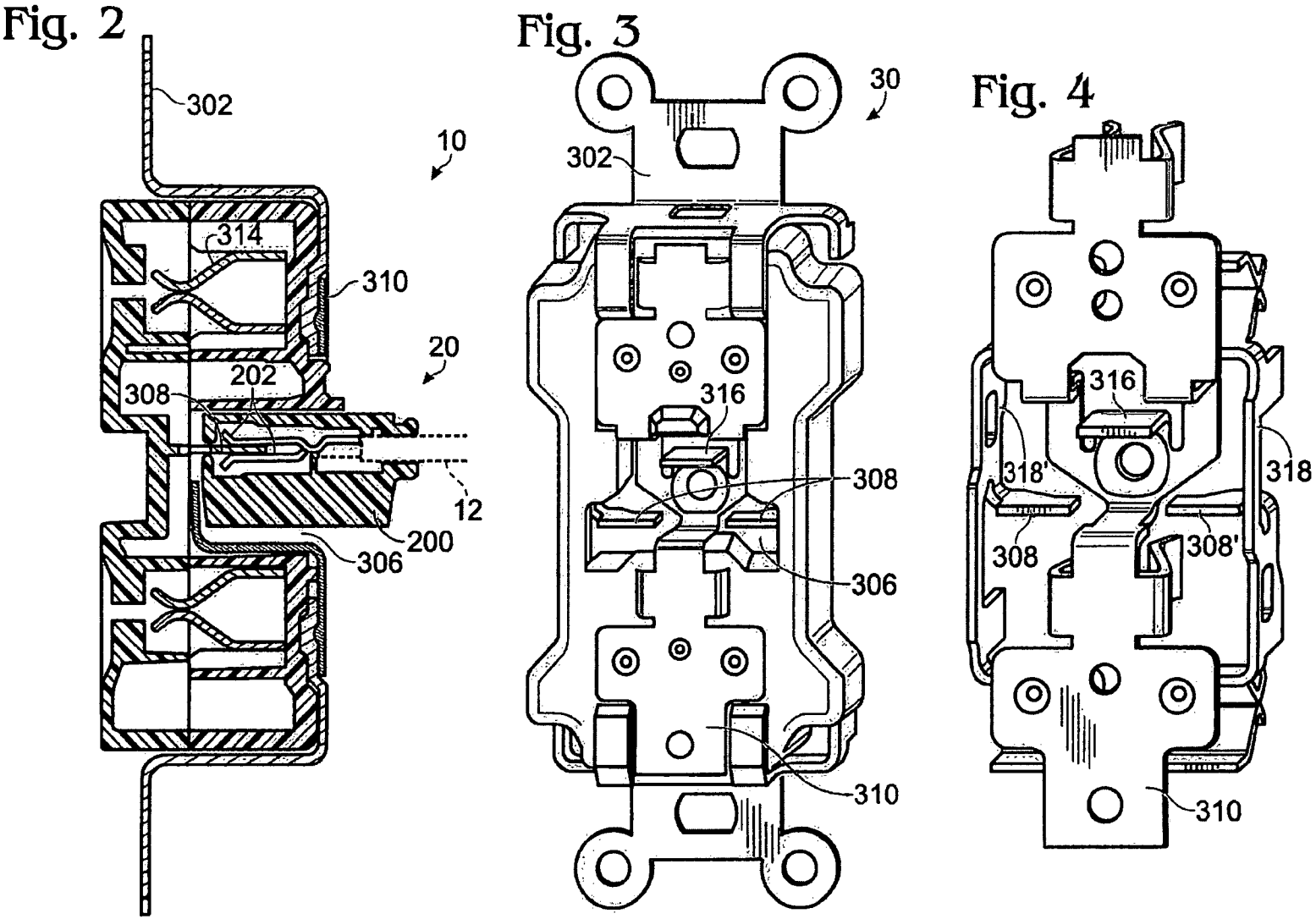
FIG. 2 is a cross-sectional view of the electrical wiring system depicted in FIG. 1B.
FIG. 3 is a back view of the wiring device depicted in FIG. 1A and FIG. 1, showing a power input receptacle.
FIG. 4 is a detail view illustrating the construction of the receptacle depicted in FIG. 3.

Referring to FIG. 2, a cross-sectional view of the electrical wiring system depicted in FIG. 1B is disclosed. Plug connector housing 200 fits within input receptacle 306. As such, male contact 308 is shown as being inserted between female contacts 202. FIG. 2 also shows power output receptacle 314, which is configured to receive the blade contacts from a plug. When plug 20 is installed in device 30, electrical continuity is established between the plurality of wires 12 and the wiring device. Thus, when wires 12 are energized, power is supplied to output receptacles 314. Those of ordinary skill in the art will recognize that while the example of FIGS. 1A and 1B shown a wiring device that provides output receptacles 314, the present invention may be practiced with any suitable type of wiring device. For example, wiring device 30 may include a switch, a dimmer switch, a GFCI, a transient voltage surge suppressor (TVSS), a timer mechanism, an occupancy sensor or other type of sensor, a thermostat, a night light, a lighting fixture, or a device that includes a combination of the above.

Figure 6:
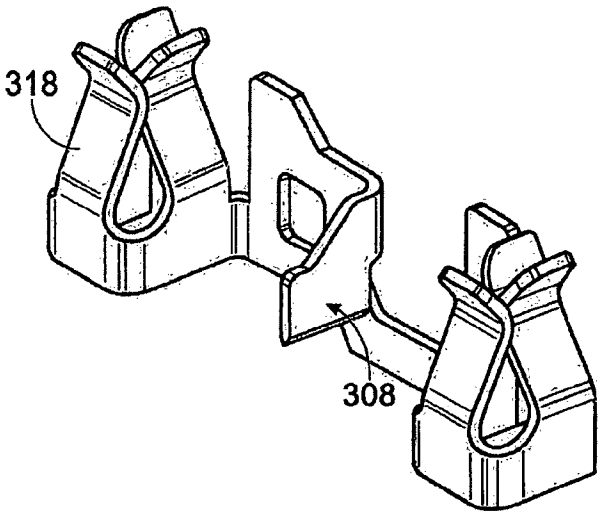
FIG. 6 is a detail view of an electrical contact body employed in the wiring device receptacle in accordance with the present invention.
Figure 5:
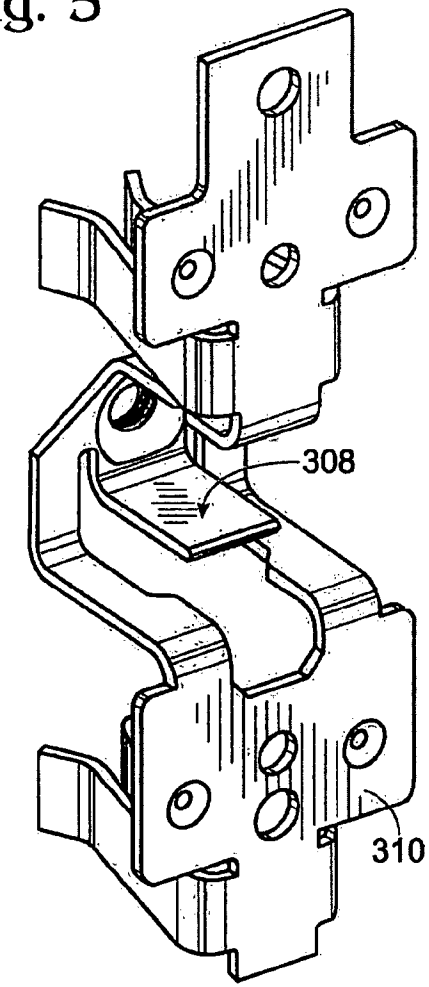
FIG. 5 is a detail view of the wiring device ground chassis in accordance with the present invention.

Referring to FIG. 3, a back view of the wiring device depicted in FIG. 1A and FIG. 1 is disclosed. As shown, receptacle 306 is shaped to accommodate plug connector 20. Receptacle 306 includes male contacts 308 and ground contact 316. Referring to FIG. 4, a detail view illustrating the construction of receptacle 316 is shown. Essentially, the contacts within receptacle 306 are formed by three metallic bodies disposed within molded body 300 (see FIG. 1A). As discussed above, ground chassis 310 includes ground contact 316. Contact body 318 includes contact 308 and supporting structure. Contact body 318' is a mirror image of contact body 318, and includes contact 308'. During fabrication, ground chassis 310 is inserted into a first side of molded body 300, and contact bodies 318, 318' are inserted into the opposing side of body 300, such that contacts 318, 318', and 316 from an integrated set of male contacts suitable for female plug connector 20. FIG. 5 is a detail view showing ground chassis 310 in isolation. FIG. 6 is a detail view of electrical contact body 318 in isolation.

Figure 7:
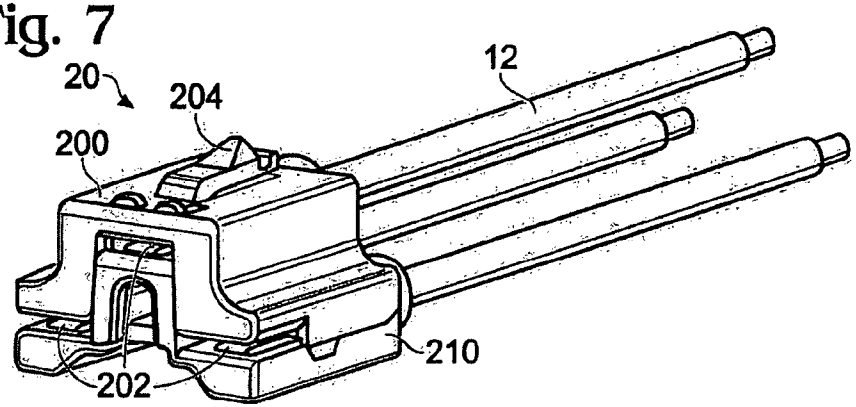
FIG. 7 is a perspective view of the plug connector in accordance with a first embodiment of the present invention.

As embodied herein and depicted in FIG. 7, perspective view of plug connector 20 in accordance with a first embodiment of the present invention is disclosed. Plug connector 20 includes upper housing 200 and lower housing 210. Upper housing 200 is snapped onto lower housing 210 to thereby enclose and terminate wires 12 in plug connector 20. Upper housing 200 includes latch mechanism 204. When plug connector 20 is inserted into receptacle 306, latch mechanism 204 prevents plug 20 from being pulled out of receptacle 306. Latch mechanism 204 is configured to meet Underwriter's Laboratory (UL) standards for a locking connector. In this case, UL requires that a static pull test of 201*b* be applied to the connector for one minute. During the test, plug connector 20 may not separate from receptacle 30.

During operation, latch mechanism 204 flexes upon insertion of plug connector 20. The flexure latch mechanism 204 relaxes to a non-flexed position upon successful locking of plug connector 20 to receptacle 306, and emits an audible snapping sound or visual indication that locking has been achieved. Flexible latch mechanism 204 may also be configured to be accessible to the finger or to a tool when plug connector 20 is locked to receptacle 306. In this embodiment, when latch mechanism 204 is accessed and manually flexed manually, or by the tool, plug connector 20 can be removed from receptacle 306. The flexure is oriented in a direction opposite to the insertion direction in order to meet requirements in Underwriters Laboratories (UL) standards. In another embodiment, plug connector 20 can be locked into receptacle 306 using screws or any number of fastening means familiar to those skilled in the art.

Figure 8:
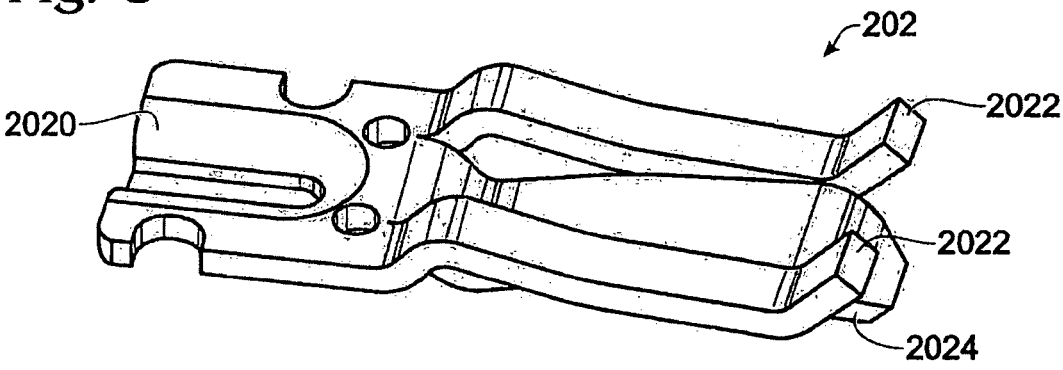
FIG. 8 is a is a detail view of the electrical contacts employed in the plug connector depicted in FIG. 7.

Referring to FIG. 8, a detail view of female electrical contact 202 is depicted. Each contact 202 includes a wire seat portion 2020. Wire seat 2020 accommodates the wire conductor when wire 12 is bonded to contact 202 during termination. Contact 202 also includes two exterior spring contact members 2022, and an interior spring contact member 2024. As those of ordinary skill in the art will appreciate, when male receptacle contacts 308 are inserted, the exterior spring contact members 2022 separate from the interior spring contact member 2024, holding contact 308 firmly therebetween.

Figure 9:
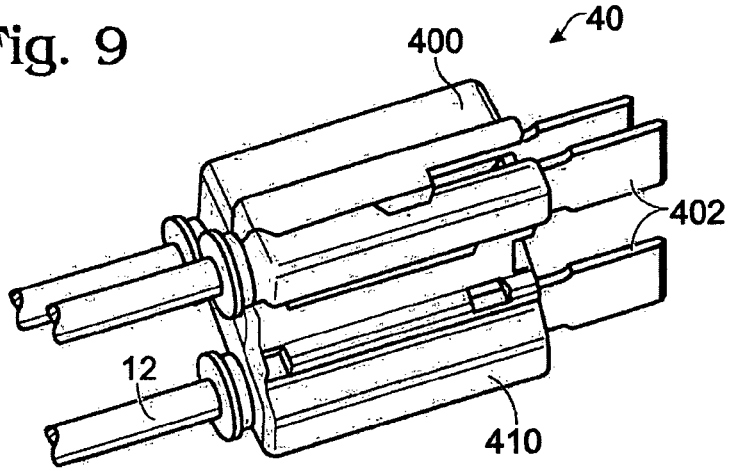
FIG. 9 is a perspective view of the plug connector in accordance with a second embodiment of the present invention.

As embodied herein and depicted in FIG. 9, a perspective view of the plug connector 40 is accordance with a second embodiment of the present invention is disclosed. Plug connector includes upper housing 400 which is mated to lower housing 410. In this embodiment, the female contacts are replaced by male contacts 402. As a result, receptacle 306, disposed in wiring device 30 (not shown), includes female contacts.

Figure 10:
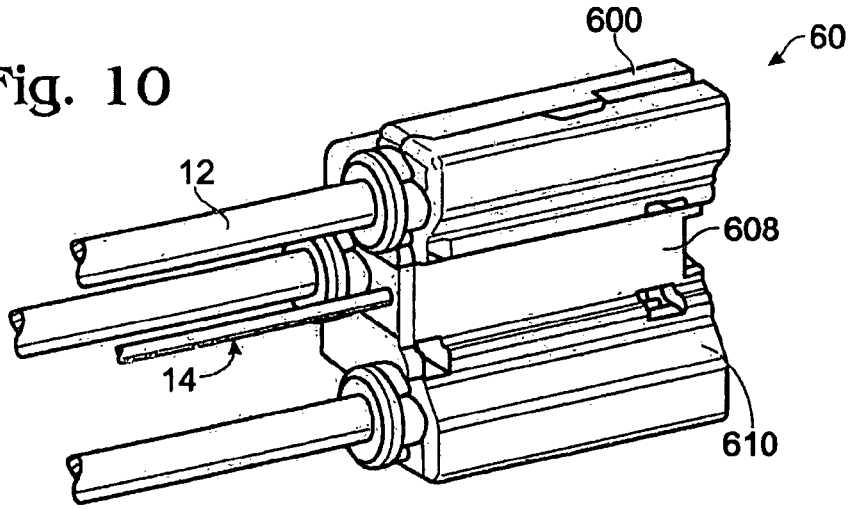
FIG. 10 is a perspective view of the plug connector in accordance with a third embodiment of the present invention.

As embodied herein and depicted in FIG. 10, a perspective view of plug connector 60 is accordance with a third embodiment of the present invention is disclosed. Like the other embodiments, plug connector 60 includes upper housing 600 and lower housing 610. However, this embodiment includes an additional contact that accommodates communications wire 14. Communications wire 14 transmits wiring device 30 status data, such as a detected fault condition, to a receiver disposed in the structure. Obviously, connector 60 mates to a wiring device 30 that includes a sensor and a transmitter. With respect to the transmitter employed by device 30, any suitable system may be employed, including optical, acoustic, or RF transmitters. For example, wiring device 30 may include an RF tag that transmits a fault detect code in the presence of a fault condition.

Figure 11:
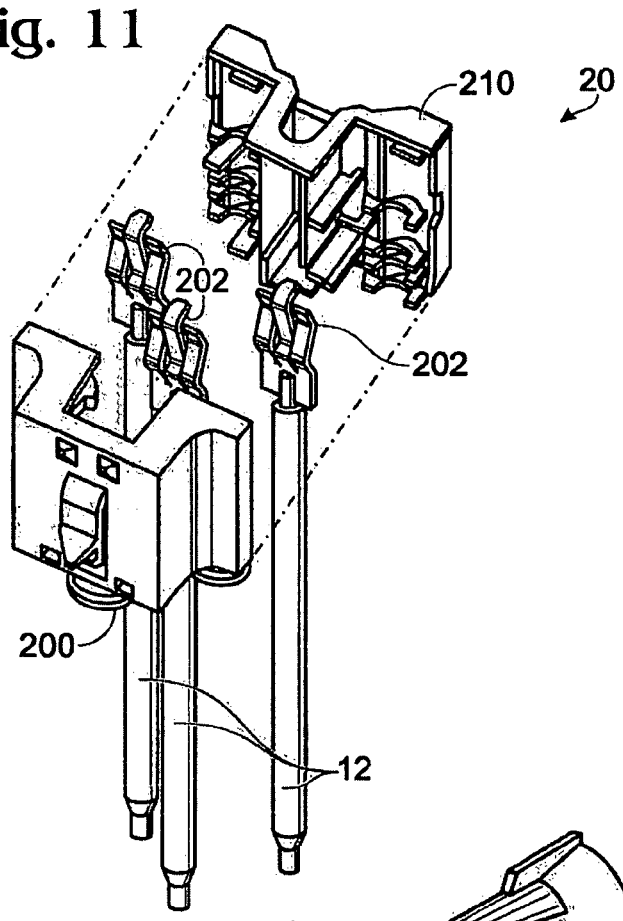
FIG. 11 is an exploded view of the plug connector depicted in FIG. 7, illustrating a first method for terminating the plug connector.

Referring to FIG. 11, an exploded view of the plug connector depicted in FIG. 7. FIG. 11 illustrates a first method for terminating plug connector 20 to wire 12. After each wire 12 is stripped, it is placed in seat 2020 (See FIG. 8), and bonded to the contact. Each contact 202 is disposed in upper housing 200. Subsequently, lower housing 210 is snapped into place to thereby secure contacts 202. In an alternate embodiment, contacts 202 are disposed in either upper housing 200 or in lower housing 210. Each contact 202 includes a blade elements. The blade elements is configured to displace insulation disposed on wire 12 when lower housing 210 is snapped onto upper housing 200. The blade element contacts the conductor after the insulation is displaced, such that electrical continuity is established between wire 12 and contact 202.

Figure 12:
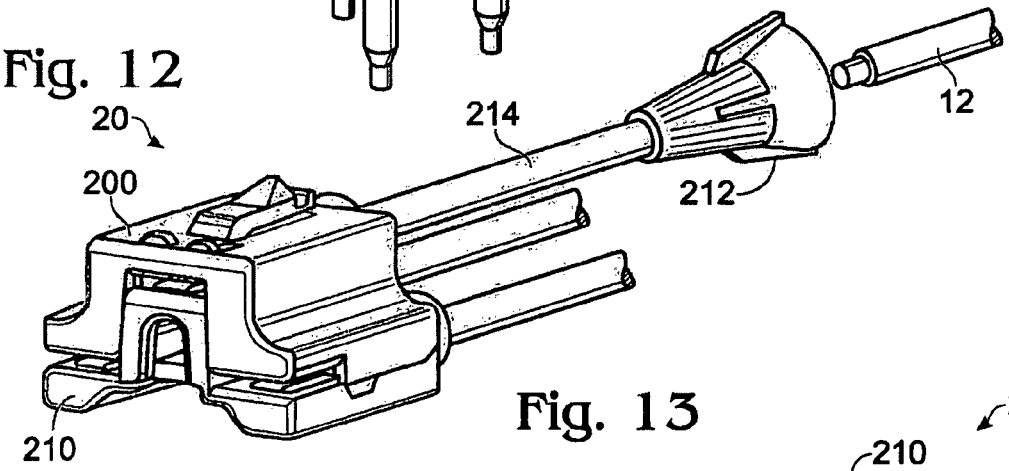
FIG. 12 is a perspective view of the plug connector depicted in FIG. 7, illustrating a second method for terminating the plug connector.

Referring to FIG. 12, a perspective view of plug connector 20 is shown, illustrating a second method for terminating wires 12 to plug connector 20. In this embodiment, plug 20 is equipped with leads 214 which are terminated to contacts 202 at the factory. During wire 12 termination, wire-nut 212 is essentially screwed onto stripped wire 12.

Figure 13:
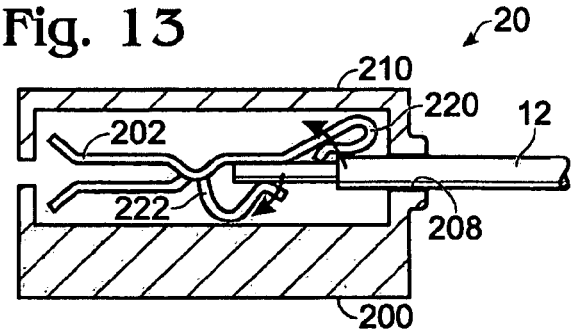
FIG. 13 is a perspective view of the plug connector depicted in FIG. 7, illustrating a third method for terminating the plug connector.

Referring to FIG. 13, a perspective view of plug connector 20 is shown, illustrating a third method for terminating wires 12 to plug connector 20. In this embodiment, each contact 202 in plug 20 is equipped with spring 220 and spring 222, which are configured to press one against the other before wire installation. When wire 12 is inserted into opening 208, spring 220 separates from spring 222. Spring 222 actuates trigger mechanism 224 which includes a metallic saw-tooth mechanism 206. Mechanism 206 bites into wire 12, securing it in place.

As those of ordinary skill in the art will recognize, the present invention is ideally suited for installing electrical wiring in any structure. During any installation, after the wires are placed between the breaker location to the location wherein the electrical device 30 is to be installed, wires 12 may be terminated to plug connector 20 using any of the methods described above. Subsequently, plug connector 20 is inserted into receptacle 306 of wiring device 30, to thereby establish electrical continuity between the electrical wiring device and the plurality of wires.

Figure 14:
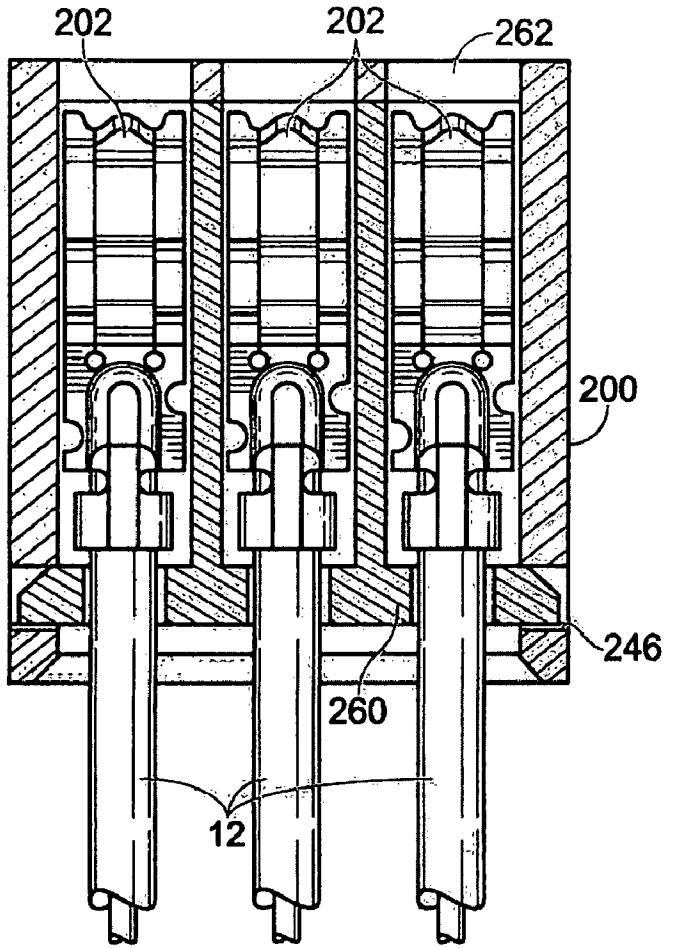
FIG. 14 is a cross-sectional view of the plug connector in accordance with an alternate embodiment of the present invention.

Referring to FIG. 14, a cross-sectional view of the plug connector 20 in accordance with an alternate embodiment of the present invention is disclosed. In this embodiment, plug connector 20 is arranged with plug contacts 202 adjacent one to the other within housing 200. Thus, contact openings 262 are likewise adjacent one to the other. Contact support member 260 is inserted into opening 264 of housing 200, to support contacts 202, which are terminated on wires 12.

Figure 15:
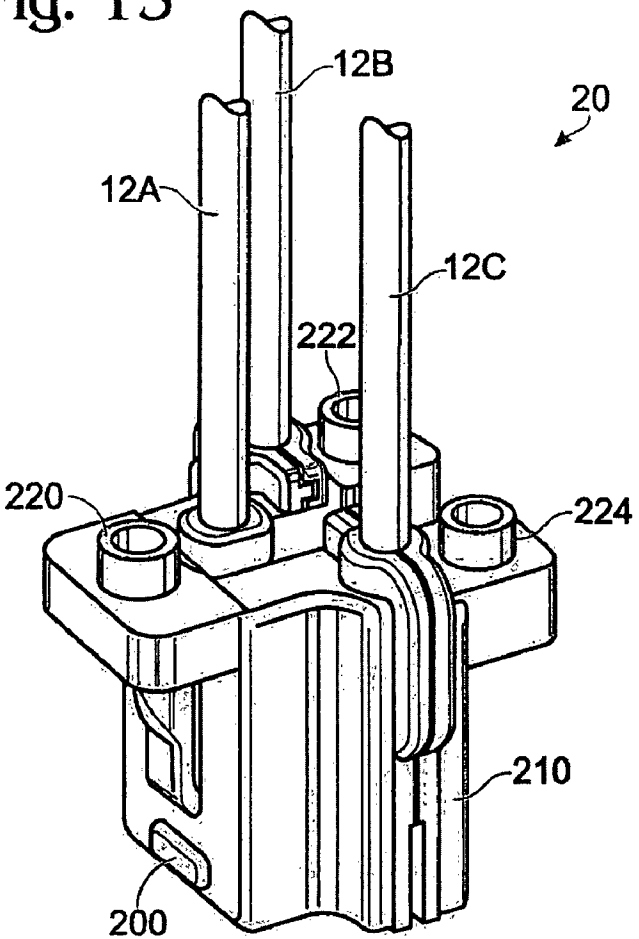
FIG. 15 is a perspective view of a feed-through plug connector in accordance with an embodiment of the invention.

Referring to FIG. 15, a perspective view of a feed-through plug connector in accordance with an embodiment of the invention. As those of ordinary skill in the art will understand, often receptacles are daisy chained by way of feed through wires. In this embodiment, there is electrical connectivity between wire 12A and wire terminal 226, wire 2B and wire terminal 228, and wire 12C and wire terminal 230. Those of ordinary skill in the art will recognize that a feed through wire may be connected to terminal 226, 228, or 230 by any suitable means. For example, the feed-through wire may be connected to the wire terminal in a pre-assembled manner, such as that shown in FIG. 7. Terminals 226, 228, and 230 may be configured as wire-nut terminals, as show in FIG. 12. Further, the method described in FIG. 13 may also be used to terminate feed-through wires to terminals 226, 228, and 230. Terminals 226, 228 and 230 can be included in connector plug 20. Alternatively, terminals 226, 228 and 230 can be in a second connector plug 20' that attaches to a receptacle 306' electrically coupled to wires 12A, 12B and 12C (not shown). Wires 12A, 12B, and 12C may couple electricity to wiring device 30 either through connector plug 20 or some alternate means such as screw terminals. In addition, connector plugs 20 and 20' may be configured so as to not be interchangeable.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. An electrical wiring system for use in an AC electrical power distribution system including a plurality of AC electric power transmitting wires configured to be disposed between an AC power distribution point and a device box, the device box including a wiring ingress aperture and an open front face for accessing an interior of the device box, the plurality of AC electric power transmitting wires being routed through the wiring ingress aperture and extending into the interior of the device box, the system comprising:

an electrical wiring device configured to be mounted to the open front face and including at least one AC electric circuit element disposed between a user accessible cover member and a rear body member, the user accessible cover member including at least one user accessible electrical interface operatively coupled to the at least one AC electric circuit element, the electrical wiring device further including a line receptacle formed in the rear body member, the line receptacle including a set of line receptacle contacts coupled to the at least one electric circuit element;

a plug connector device including a set of plug contacts disposed within a plug device housing, the plug device housing including a set of line connection apertures configured to accommodate the plurality of line receptacle contacts disposed in the line receptacle and a plurality of wire termination apertures configured to accommodate the plurality of AC electric power transmitting wires accessible via the open front face, each plug contact including a line plug contact and a wire termination contact arrangement, each wire termination contact arrangement being aligned with a corresponding wire termination aperture and configured to terminate one of the plurality of AC electric power transmitting wires disposed in its corresponding wire termination aperture, each line plug contact being aligned with a corresponding line connection aperture and configured to mate with a corresponding line receptacle contact, electrical continuity being established between the electrical wiring device and the plurality of AC electric power transmitting wires when the plug connector device is inserted into the line receptacle such that the set of line plug contacts mate with corresponding ones of the set of line receptacle contacts.

2. The system of claim 1, wherein the set of line connection apertures are disposed at a first end of the plug device housing and the plurality of wire termination apertures are disposed at a second end of the plug device housing.

3. The system of claim 1, wherein each plug contact is characterized by a longitudinal axis such that its line plug contact is disposed at a first end of the plug device housing and its wire termination contact arrangement is disposed at a second end of the plug device housing opposite the first end.

4. The system of claim 1, wherein the at least one user accessible electrical interface includes at least one set of user-accessible receptacle openings and the at least one AC electric circuit element includes a hot contact structure and a neutral contact structure.

5. The system of claim 4, wherein the hot contact structure includes a hot receptacle contact disposed in communication with a hot user-accessible receptacle opening of the at least one set of user-accessible receptacle openings and the neutral contact structure includes a neutral receptacle contact disposed in communication with a neutral user-accessible receptacle opening of the at least one set of user-accessible receptacle openings.

6. The system of claim 5, wherein the hot contact structure includes a hot line receptacle contact of the set of line receptacle contacts and the neutral contact structure includes a neutral line receptacle contact of the set of line receptacle contacts.

7. The system of claim 4, wherein the at least one set of user-accessible receptacle openings includes two sets of user-accessible receptacle openings in communication with corresponding sets of receptacle contacts.

8. The system of claim 1, wherein the at least one user accessible electrical interface includes a switch actuator and the at least one AC electric circuit element includes a switching mechanism.

9. The system of claim 1, wherein the line plug contact includes a spring loaded flexure arm arrangement and the line receptacle contact is configured as a blade contact configured to be removably inserted between the spring loaded flexure arm arrangement.

10. The system of claim 1, wherein the wire termination contact arrangement includes a non-releasable push-wire terminal configured to permanently terminate and secure an AC electric power transmitting wire inserted into its corresponding wire termination aperture.

11. The system of claim 1, wherein the wire termination contact arrangement includes a spring loaded mechanism configured to non-releasably secure an AC electric power transmitting wire inserted therein, the spring loaded mechanism being configured to withstand a predetermined pulling force for a predetermined period of time.

12. The system of claim 11, wherein the spring loaded mechanism includes a toothed structure configured to bite into a portion of the corresponding AC electric power transmitting wire.

13. The system of claim 11, wherein the predetermined pulling force is less than or equal to twenty pounds and the predetermined period of time is at least one minute.

14. The system of claim 1, wherein the wire termination contact arrangement includes an insulation displacement arrangement configured to non-releasably secure an AC electric power transmitting wire within the plug device housing.

15. The system of claim 1, wherein the plug device housing includes a first housing portion and a second housing portion, and wherein the wire termination contact arrangement includes a plurality of blade elements, the plurality of blade elements being configured to displace insulation disposed on an AC electric power transmitting wires when the first housing portion is connected to the second housing portion such that electrical continuity is established between the AC electric power transmitting wires and the set of plug contacts.

16. The system of claim 1, wherein each plug contact is configured as an integral conductive structure including the line plug contact and the wire termination contact arrangement.

17. The system of claim 1, wherein the plurality of wire termination apertures includes a first set of wire termination apertures configured to accommodate the plurality of AC electric power transmitting wires and a second set of wire termination apertures configured to accommodate a plurality of load feed-through electric power transmitting wires electrically coupled to the at least one AC electric circuit element.

18. The system of claim 1, wherein the plug connector device and the line receptacle are configured such that the plug connector device is disposed within the line receptacle in a removably latched relationship when the plug connector device is inserted into the line receptacle.

19. The system of claim 18, wherein the removably latched relationship is configured to withstand a predetermined pulling force for a predetermined period of time.

20. The system of claim 19, wherein the predetermined pulling force is at less than or equal to twenty pounds and the predetermined period of time is at least one minute.

21. The system of claim 18, wherein the plug connector device includes a flexible latching element and the line receptacle includes a substantially fixed latch keep element, the plug connector device being removably secured within the line receptacle when the flexible latching element engages the substantially fixed latch keep element, the flexible latching element and the substantially fixed latch keep element comprising a latch mechanism.

22. The system of claim 21, wherein the latch mechanism is configured to withstand a predetermined pulling force for a predetermined period of time.

23. The system of claim 22, wherein the predetermined pulling force is at less than or equal to twenty pounds and the predetermined period of time is at least one minute.

24. The system of claim 21, wherein the plug connector device may be removed from the line receptacle by depressing the flexible latching element and applying a pulling force, the flexible latching element being disengaged from the substantially fixed latch keep element when in a depressed state.

25. The system of claim 1, wherein the AC power distribution point is a junction box or an AC power distribution panel.

26. A method for installing an electrical wiring system in an AC electrical power distribution system including a plurality of AC electric power transmitting wires configured to be disposed between an AC power distribution point and a device box, the device box including a wiring ingress aperture and an open front face for accessing an interior of the device box, the plurality of AC electric power transmitting wires being routed through the wiring ingress aperture and extending into the interior of the device box such that lead-end portions of the AC electric power transmitting wires are accessible via the open front face, the method comprising the steps of:

a. providing a connector device including a plurality of connector contacts disposed within a connector device housing, each connector contact including a line connector contact coupled to a wire termination contact arrangement;

b. terminating each of the lead-end portions of the plurality of AC electric power transmitting wires to a corresponding wire termination contact arrangement within the connector device housing;

c. providing an electrical wiring device including at least one AC electric circuit element disposed in a device housing between a user accessible cover member and a rear body member, the user accessible cover member including at least one electrical interface operatively coupled to at least one circuit element, the rear body member including a line interface mechanism, the line interface mechanism including a plurality of line interface contacts coupled to the at least one AC electric circuit element; and d. coupling the connector device to the line interface mechanism such that each line connector contact is mated with a corresponding line interface contact to establish electrical continuity between the AC electric power transmitting wires and the electrical wiring device.

27. The method of claim 26, wherein the step of terminating includes inserting each of the lead-end portions of the plurality of AC electric power transmitting wires into a corresponding push-wire terminal disposed in the connector device, each push-wire terminal including one of the wire termination contact arrangements.

28. The method of claim 26, wherein the connector device housing includes a first housing portion and a second housing portion, and wherein the wire termination contact arrangement includes a plurality of blade elements, the plurality of blade elements being configured to displace insulation disposed on the plurality of AC electric power transmitting wires, and wherein the step of terminating includes connecting the first housing portion to the second housing portion such that the plurality of blade elements for each wire termination contact arrangement displace insulation disposed on a corresponding one of the AC electric power transmitting wires, electrical continuity being thereby established between the plurality of AC electric power transmitting wires and the plurality of connector contacts.

29. The method of claim 26, wherein the step of coupling the connector device to the line interface mechanism includes interlocking or latching the connector device to the line interface mechanism.

30. An electrical wiring system for use in an AC electrical power distribution system including a plurality of AC electric power transmitting wires configured to be disposed between an AC power distribution point and a device box, the device box including a wiring ingress aperture and an open front face for accessing an interior of the device box, the plurality of AC electric power transmitting wires being routed through the wiring ingress aperture and extending into the interior of the device box such that lead-end portions of the AC electric power transmitting wires are accessible via the open front face, the system comprising:

an electrical wiring device including at least one AC electric circuit element disposed within a device housing between a user-accessible cover member and a rear body member, the user-accessible cover member including at least one electrical interface operatively coupled to at least one circuit element, the rear body member including a line interface mechanism, the line interface mechanism including a plurality of line interface contacts coupled to the at least one AC electric circuit element; and a terminating connector device including a plurality of connector contacts disposed within a terminating connector device housing, each connector contact including a line connector contact coupled to a wire termination contact arrangement, each wire termination contact arrangement being configured to terminate the lead-end portion of a corresponding one of the plurality of AC electric power transmitting wires within the terminating connector device housing, each line connector contact being configured to mate with a corresponding line interface contact when the terminating connector device is coupled to the line interface mechanism to establish electrical continuity the electrical wiring device and the plurality of AC electric power transmitting wires.

31. An electrical wiring system for use in an AC electrical power distribution system including a plurality of AC electric power transmitting wires configured to be disposed between an AC power distribution point and a device box, the device box including a wiring ingress aperture and an open front face for accessing an interior of the device box, the plurality of AC electric power transmitting wires being routed through the wiring ingress aperture and extending into the interior of the device box, the system comprising:

a terminating connector device including a connector device housing, a line hot plug contact and a line neutral plug contact, the line hot plug contact being coupled to a line hot termination element and the line neutral plug contact being coupled to a line neutral termination element, the line hot termination element being configured to couple a hot AC electric power transmitting wire of the plurality of AC electric power transmitting wires to the line hot plug contact without any intervening connection to the device box, the line neutral termination element being configured to couple a neutral AC electric power transmitting wire of the plurality of AC electric power transmitting wires to the line neutral plug contact without any intervening connection to the device box; and an electrical wiring device including an enclosure formed by a user accessible cover member and a rear body member, a mounting plate being partially disposed within the enclosure, portions of the mounting plate being configured to mount the electrical wiring device to the open front face of the device box, the user accessible cover member including a plurality of apertures formed therein, the plurality of apertures including at least one hot aperture conforming to a hot plug blade and at least one neutral aperture conforming to a neutral plug blade, the rear body member including a connector receptor portion configured to accommodate the terminating connector device, the connector receptor portion including a raised portion substantially disposed around at least a portion of a perimeter of the connector receptor portion, the enclosure further including a hot terminal structure and a neutral terminal structure disposed therein, the hot terminal structure including at least one hot face contact substantially aligned with the at least one hot aperture and a hot connector receptor contact structure configured to mate with the line hot plug contact when the terminating connector device is coupled to the connector receptor portion, the neutral terminal structure including at least one neutral face contact substantially aligned with the at least one neutral aperture and a neutral connector receptor contact structure configured to mate with the line neutral plug contact when the terminating connector device is coupled to the connector receptor portion.

32. The system of claim 31, further comprises a latching mechanism configured to lock the terminating connector device to the connector receptor portion when the terminating connector device is coupled to the connector receptor portion, the locking mechanism being configured to unlock the terminating connector device from the connector receptor portion when the terminating connector device is decoupled from the connector receptor portion.

33. The system of claim 32, wherein the locking mechanism is configured to withstand a predetermined pulling force for a predetermined period of time.

34. The system of claim 33, wherein the predetermined pulling force is less than or equal to twenty pounds and the predetermined period of time is at least one minute.

35. The system of claim 31, wherein the raised portion comprises a flexible latching element and the connector receptor portion includes a substantially fixed latch keep element, the terminating connector device being removably secured within the connector receptor portion when the flexible latching element engages the substantially fixed latch keep element, the flexible latching element and the substantially fixed latch keep element comprising a latching mechanism.

36. The system of claim 31, wherein the plurality of apertures includes two sets of user-accessible receptacle openings, and the at least one hot face contact includes a plurality of hot face contacts and the at least one neutral face contact includes a plurality of neutral face contacts such that the two sets of user-accessible receptacle openings are in communication with corresponding sets of face contacts.

37. The system of claim 31, wherein the line hot termination element and line hot plug contact are disposed within the connector device housing, and wherein the line neutral termination element and line neutral plug contact are disposed within the connector device housing.

* * * * *